US009979127B2

(12) United States Patent
Zhang et al.

(10) Patent No.: US 9,979,127 B2
(45) Date of Patent: May 22, 2018

(54) ELECTRICAL CONNECTOR AND ELECTRICAL CONNECTOR ASSEMBLY

(71) Applicants: Tyco Electronics (Shanghai) Co. Ltd., Shanghai (CN); TE Connectivity Corporation, Berwyn, PA (US); Tyco Electronics Svenska AB, Vasby (SE)

(72) Inventors: Zhicheng Zhang, Shanghai (CN); Guangming Zhao, Shanghai (CN); Rickard Barrefelt, Berwyn, PA (US); David Patrick Orris, Berwyn, PA (US)

(73) Assignees: Tyco Electronics (Shanghai) Co. Ltd., Shanghai (CN); TE Connectivity Corporation, Berwyn, PA (US); Tyco Electronics Svenska AB, Vasby (SE)

( * ) Notice: Subject to any disclaimer, the term of this patent is extended or adjusted under 35 U.S.C. 154(b) by 0 days. days.

(21) Appl. No.: 15/463,689

(22) Filed: Mar. 20, 2017

(65) Prior Publication Data

US 2017/0194741 A1 Jul. 6, 2017

Related U.S. Application Data

(63) Continuation of application No. PCT/IB2015/057191, filed on Sep. 18, 2015.

(30) Foreign Application Priority Data

Sep. 19, 2014 (CN) ..... 2014 1 0482109

(51) Int. Cl.
*H01R 13/62* (2006.01)
*H01R 13/629* (2006.01)

(52) U.S. Cl.
CPC . *H01R 13/62938* (2013.01); *H01R 13/62961* (2013.01)

(58) Field of Classification Search
CPC ..... H01R 13/62961; H01R 13/62938
(Continued)

(56) References Cited

U.S. PATENT DOCUMENTS 4,917,627 A * 4/1990 Hendricks ..... H01R 13/6272 24/665
5,586,911 A * 12/1996 Miller ..... H01R 13/65802 439/607.28

(Continued)

FOREIGN PATENT DOCUMENTS

DE 202007011306 U1 1/2008
EP 2392955 A1 7/2011

(Continued)

OTHER PUBLICATIONS

Notification of transmittal, International Preliminary Report on Patentability and Written Opinion of the International Searching Authority, dated Mar. 30, 2017, 8 pages.

(Continued)

*Primary Examiner* — Abdullah Riyami
*Assistant Examiner* — Nelson R Burgos-Guntin
(74) *Attorney, Agent, or Firm* — Barley Snyder

(57) ABSTRACT

An electrical connector includes a housing, a lock mechanism, a trigger, and a strap. The lock mechanism is mounted on the housing and has a locking member. The lock mechanism is movable between a locking position in which the locking member locks the electrical connector to a mating electrical connector and an unlocking position in which the locking member is disengaged from the mating electrical connector. The trigger is pivotally mounted on the housing and is movable between a deactivated position and an activated position. The trigger moves the lock mechanism from the locking position to the unlocking position as the trigger moves between the deactivated position and the (Continued)

activated position. The strap is connected to the trigger and moves the trigger from the deactivated position to the activated position upon applying an activation force to the strap.

23 Claims, 8 Drawing Sheets

(58) Field of Classification Search
USPC ..... 439/372, 160, 353, 497
See application file for complete search history.

(56) References Cited

U.S. PATENT DOCUMENTS 7,445,485 B1 * 11/2008 Wu ..... H01R 13/514 439/160
8,251,733 B2 * 8/2012 Wu ..... H01R 13/512 439/160
8,597,045 B2 * 12/2013 Zhu ..... H01R 13/506 439/357
8,662,917 B2 * 3/2014 Wang ..... H01R 9/038 439/493
8,926,347 B2 * 1/2015 Zhu ..... H01R 13/62 439/159
8,986,036 B2 * 3/2015 Lindkamp ..... G02B 6/4246 439/160
2009/0227133 A1 * 9/2009 Zhang ..... G02B 6/4246 439/160
2010/0248522 A1 * 9/2010 Crofoot ..... H01R 13/6275 439/350
2012/0164860 A1 * 6/2012 Wang ..... G02B 6/4261 439/159
2012/0171879 A1 * 7/2012 Wang ..... H01R 13/6335 439/160
2012/0171903 A1 * 7/2012 Wang ..... H01R 13/508 439/660
2012/0248522 A1 10/2012 Goyal et al.
2012/0252256 A1 * 10/2012 Zhu ..... H01R 13/506 439/357
2012/0294571 A1 * 11/2012 Kappla ..... H01R 13/6275 385/76
2013/0040487 A1 * 2/2013 Gassauer ..... H01R 13/6335 439/352
2013/0115794 A1 * 5/2013 Chang ..... H01R 13/6335 439/160
2013/0323949 A1 * 12/2013 De Dios Martin ..... H01R 13/6272 439/160
2015/0044898 A1 * 2/2015 Dobler ..... H01R 13/6275 439/352
2017/0194741 A1 * 7/2017 Zhang ..... H01R 13/62961

FOREIGN PATENT DOCUMENTS

EP 2741377 A1 6/2014
WO 2012015871 A2 2/2012

OTHER PUBLICATIONS

PCT Notification, International Search Report and Written Opinion, dated Nov. 19, 2015, 11 pages.

* cited by examiner

ELECTRICAL CONNECTOR AND ELECTRICAL CONNECTOR ASSEMBLY

CROSS-REFERENCE TO RELATED APPLICATIONS

This application is a continuation of PCT International Application No. PCT/IB2015/057191, filed on Sep. 18, 2015, which claims priority under 35 U.S.C. § 119 to Chinese Patent Application No. 201410482109.3, filed on Sep. 19, 2014.

FIELD OF THE INVENTION

The present invention relates to an electrical connector, and more particularly, to an electrical connector having a lock mechanism.

BACKGROUND

In the prior art, in order to prevent a plug electrical connector from being accidentally disengaged from a receptacle electrical connector after the plug and receptacle electrical connectors are coupled together, a lock mechanism is generally formed on the plug electrical connector. When the plug electrical connector is inserted into the receptacle electrical connector, the plug electrical connector and the receptacle electrical connector are locked by the lock mechanism. It is necessary to release the lock mechanism before pulling the plug electrical connector out of the receptacle electrical connector.

In the prior art, the lock mechanism generally comprises a horizontal elastic piece. When an operator presses the horizontal elastic piece downward in a vertical direction by his/her fingers or a tool, the lock mechanism is released. However, releasing the lock mechanism by pressing the horizontal elastic piece in the vertical direction requires a large operation space for the operator's fingers especially in the vertical direction. In some conditions where the electrical connectors are arranged in a high density, there is not enough operation space between adjacent electrical connectors in the vertical direction, and releasing the lock mechanism by pressing the horizontal elastic piece in the vertical direction becomes very difficult or even impossible. Therefore, in arrangements of known electrical connectors, the connectors cannot be arranged in high density, and there is a large distance between adjacent electrical connectors in the vertical direction. Furthermore, the lock mechanism of known electrical connectors is often very complicated, increasing the cost of the electrical connector.

SUMMARY

An object of the invention, among others, is to provide an electrical connector which can be arranged in high density having a simple, low cost locking mechanism. The disclosed electrical connector includes a housing, a lock mechanism, a trigger, and a strap. The lock mechanism is mounted on the housing and has a locking member. The lock mechanism is movable between a locking position in which the locking member locks the electrical connector to a mating electrical connector and an unlocking position in which the locking member is disengaged from the mating electrical connector. The trigger is pivotally mounted on the housing and is movable between a deactivated position and an activated position. The trigger moves the lock mechanism from the locking position to the unlocking position as the trigger moves between the deactivated position and the activated position. The strap is connected to the trigger and moves the trigger from the deactivated position to the activated position upon applying an activation force to the strap.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
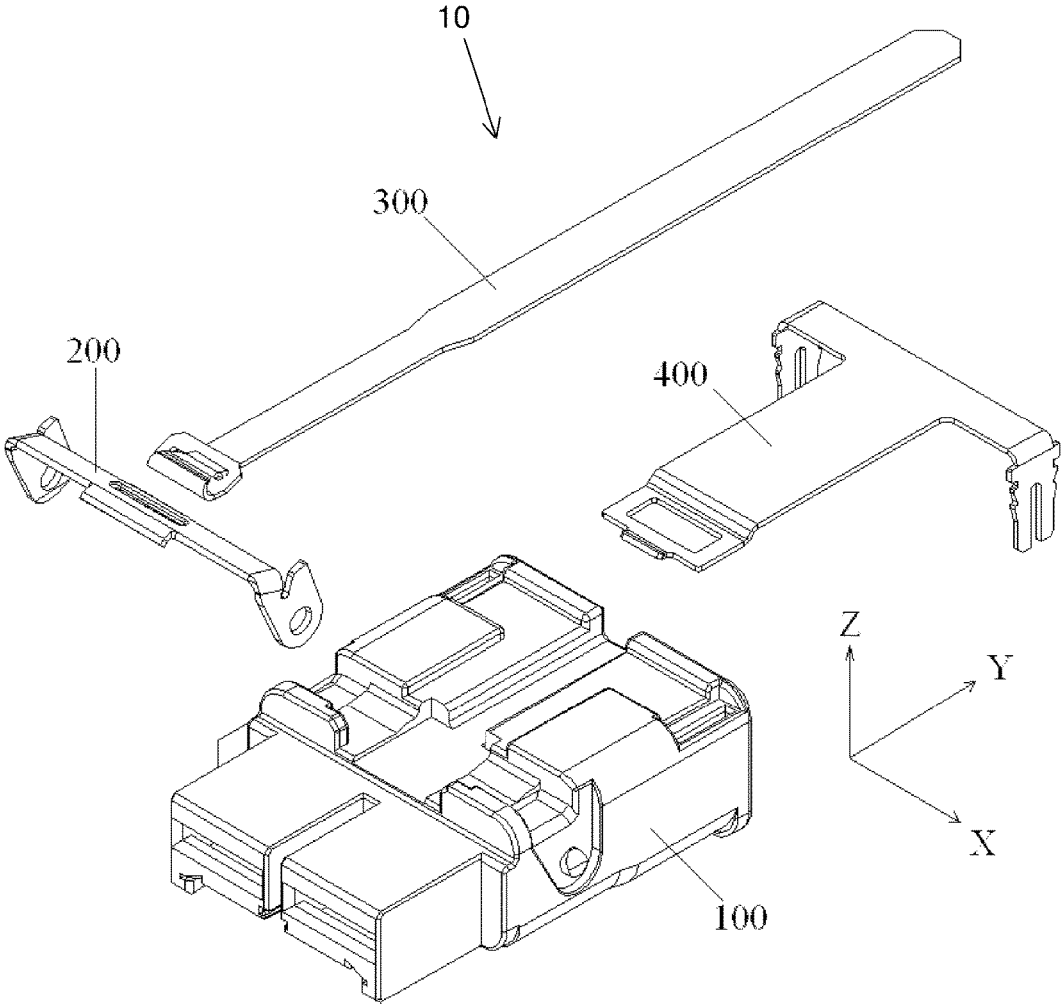
FIG. 1 is an exploded perspective view of an electrical connector according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

An electrical connector 10 according to the invention is shown generally in FIG. 1. The electrical connector 10 comprises a housing 100, a trigger 200, a strap 300 used as an operation member, a lock mechanism 400 and conductive contacts disposed in the housing 100.

Figure 2:
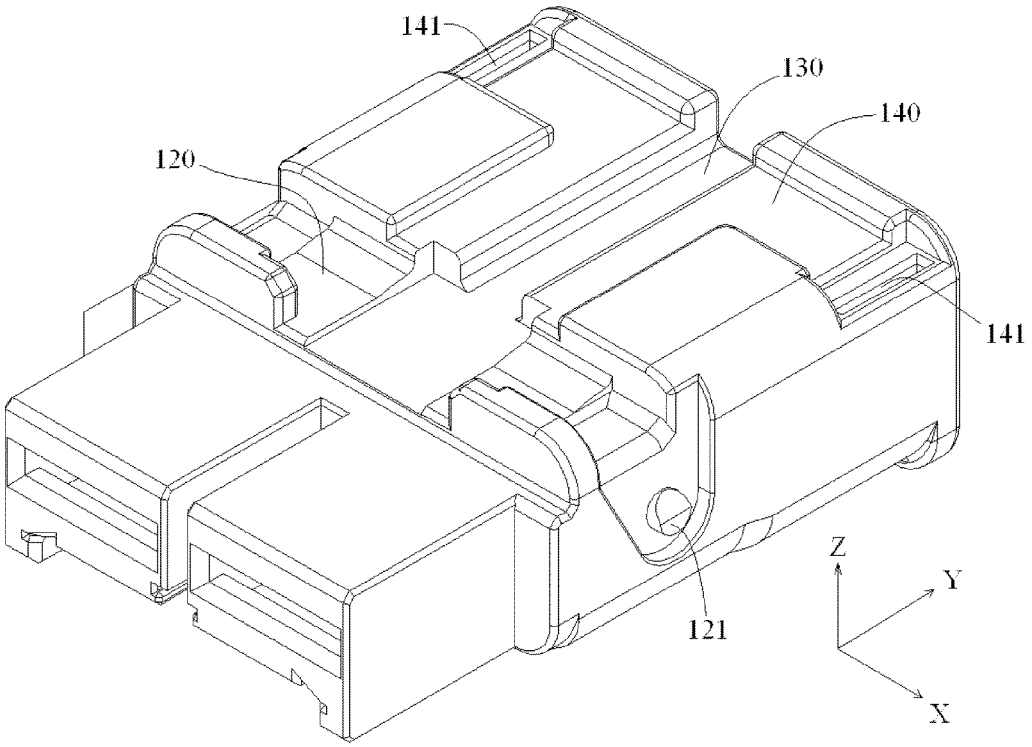
FIG. 2 is a perspective view of a housing of the electrical connector of FIG. 1.

The housing 100 is shown in FIG. 2. The housing 100 has a first groove 120 extending in a width direction X, a second groove 130 extending in a length direction Y, a third groove 140 extending in the width direction X. The housing 100 also has a plurality of shafts 121 and a plurality of slots 141.

Figure 3:
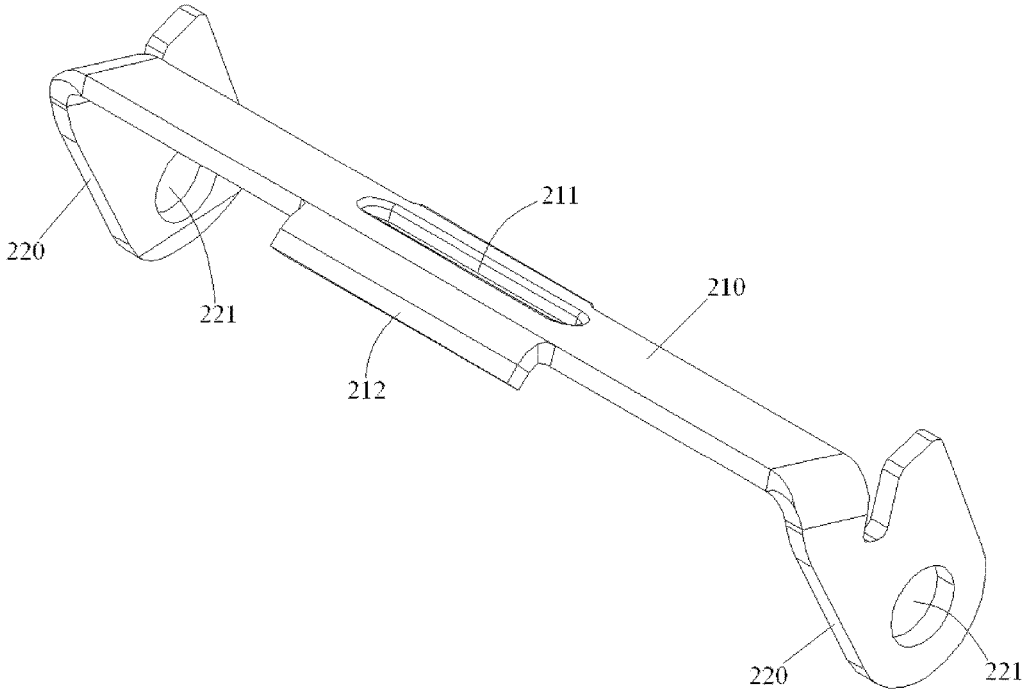
FIG. 3 is a perspective view of a trigger of the electrical connector of FIG. 1.

The trigger 200 is shown in FIG. 3. The trigger 200 has a lateral beam 210 and a pair of end plates 220 located at both ends of the lateral beam 210, respectively. In the shown embodiment, the trigger 200 has a substantial U-shape. A first slot 211 is formed in the lateral beam 210 and a pushing protrusion 212 is formed on the lateral beam 210. A hole 221 is formed in each end plate 220.

Figure 4:
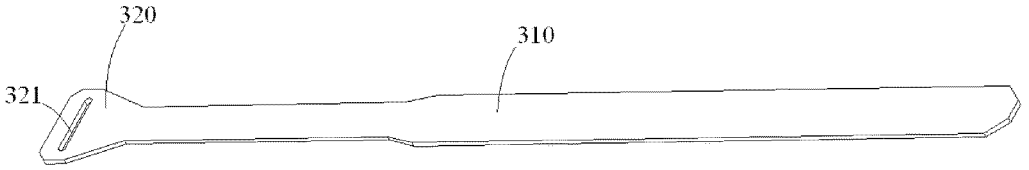
FIG. 4 is a perspective view of a strap of the electrical connector of FIG. 1.

The strap 300 is shown in FIG. 4. The strap 300 has a tape-like body 310 and an enlarged end portion 320 at one end of the tape-like body 310. A second slot 321 is formed in the enlarged end portion 320. In the shown embodiment, the strap 300 is a flexible belt made of a flexible material. The strap 300 may alternatively be a flexible rope, or a strap or rod made of a rigid material.

Figure 5:
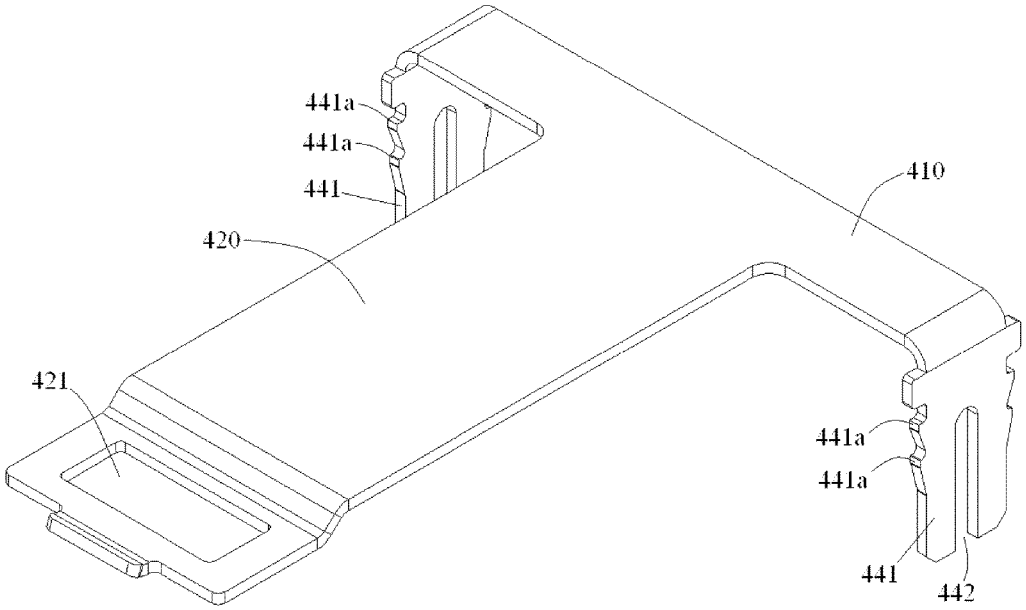
FIG. 5 is a perspective view of a lock mechanism of the electrical connector of FIG. 1.

The lock mechanism 400 is shown in FIG. 5. The lock mechanism 400 has a lateral connection arm 410, a resilient arm 420, and a pair of connection pegs 441. The resilient arm 420 has a locking member 421 disposed at a first end. The lateral connection arm 410 is connected to an opposite second end of the resilient arm 420 and extends perpendicularly with respect to the resilient arm 420 such that the lock 400 has a substantial T-shape. The pair of connection pegs 441 extend downward from both ends of the lateral connection arm 410. A slit 442 is formed in each connection peg 441, so as to increase the flexibility of each connection peg 441. Projections 441*a* are formed on both sides of each connection peg 441.

Assembly of the electrical connector 10 will now be described in greater detail with reference to FIGS. 1, 6, and 7.

The end plates 220 are pivotally connected to the housing 100, so that the trigger 200 is disposed in the first groove 120 and rotatable about an axis in the width direction X of the housing 100. The hole 221 formed in each end plate 220 is mated with one shaft 121 of the housing, as shown in FIG. 6.

Figure 6:
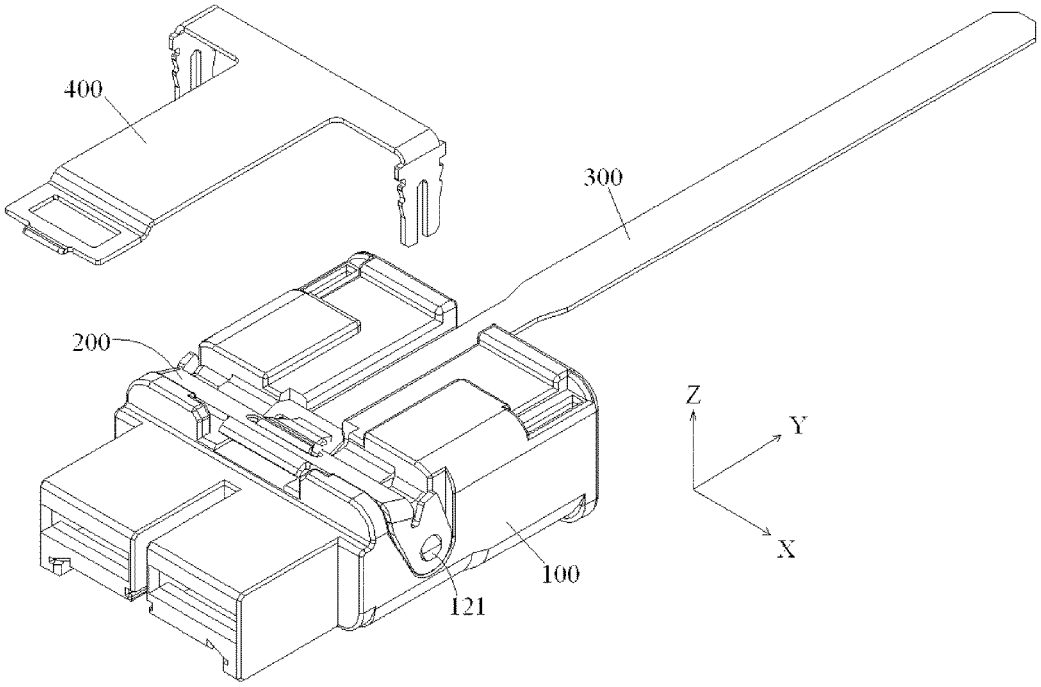
FIG. 6 is a partially exploded perspective view of the electrical connector of FIG. 1.

The strap 300 is placed on a top surface of the housing 100 in the second groove 130 and horizontally extends beyond a rear end of the housing 100 in the length direction Y of the housing 100, as shown in FIG. 6. An end of the strap 300 opposite to the enlarged end portion 320 passes through the first slot 211 and then the second slot 321. In this way, the strap 300 is connected to the lateral beam 210 of the trigger 200. In an alternative embodiment in which the strap 300 is a flexible rope made of a flexible material, one end of the rope is tied to the lateral beam 210 of the trigger 200, for example, to the first slot 211.

Figure 7:
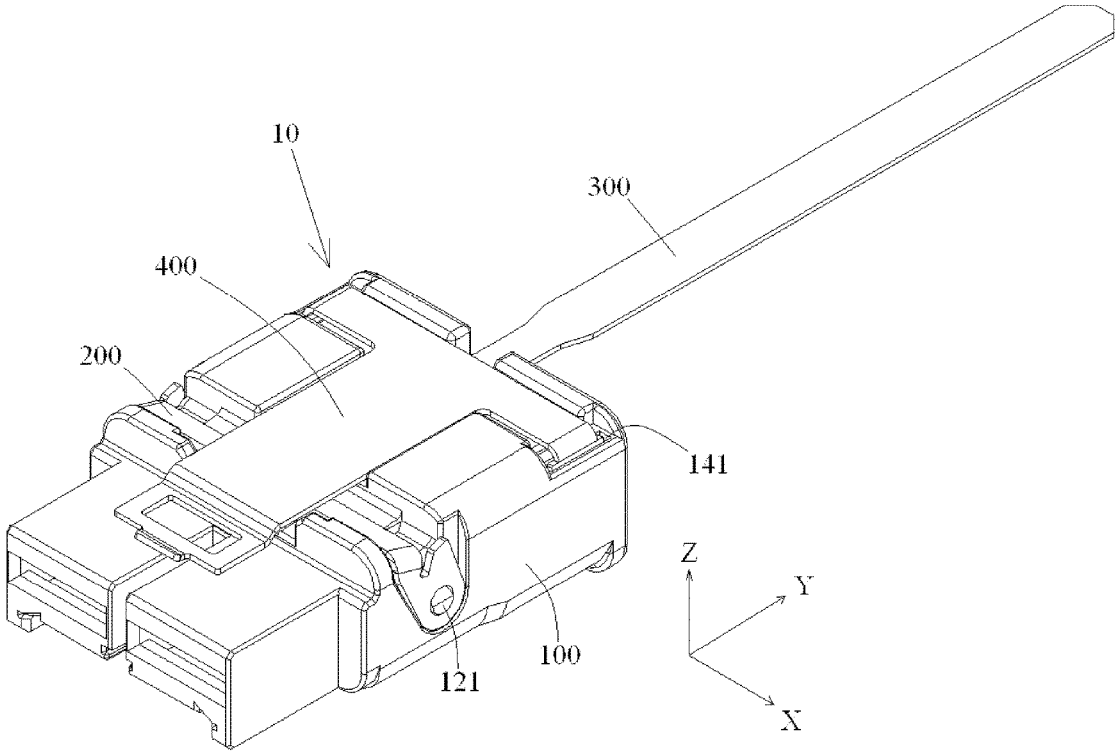
FIG. 7 is a perspective view of the electrical connector of FIG. 1.

As shown in FIGS. 6 and 7, the resilient arm 420 of the lock mechanism 400 extends in the length direction Y of the housing 100 and the lateral connection arm 410 extends in the width direction X of the housing 100 in the third groove 140. The pair of connection pegs 441 are inserted into the slots 141 of the housing 100 and the projections 441*a* engage respective recesses formed in inner walls of the slots 141. The resilient arm 420 of the lock mechanism 400 is located above the lateral beam 210 of the trigger 200.

The trigger 200, the strap 300, and the lock mechanism 400 are positioned and received in the first, second and third grooves 120, 130, 140 formed in the housing 100, without occupying any additional space outside the top surface of the housing 100; in this way, the size of the entire electrical connector 10 can be reduced, and the electrical connectors can be arranged in higher density.

Figure 8:
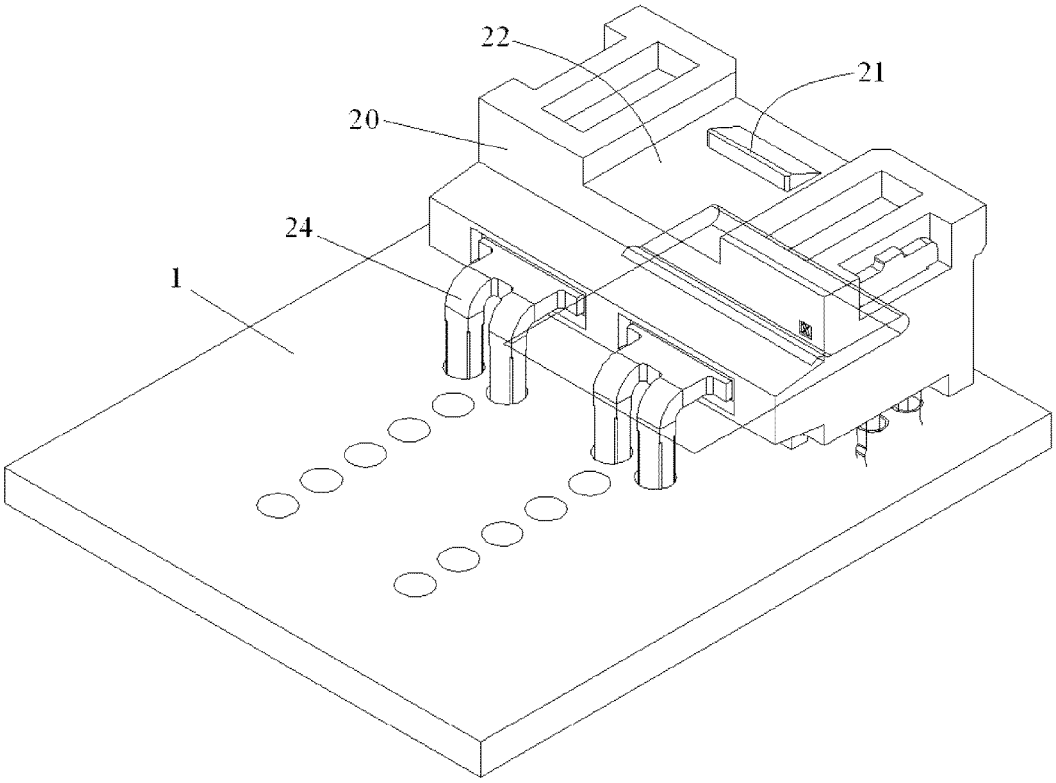
FIG. 8 is a top perspective view of a mating electrical connector for mating with the electrical connector of FIG. 7.
Figure 9:
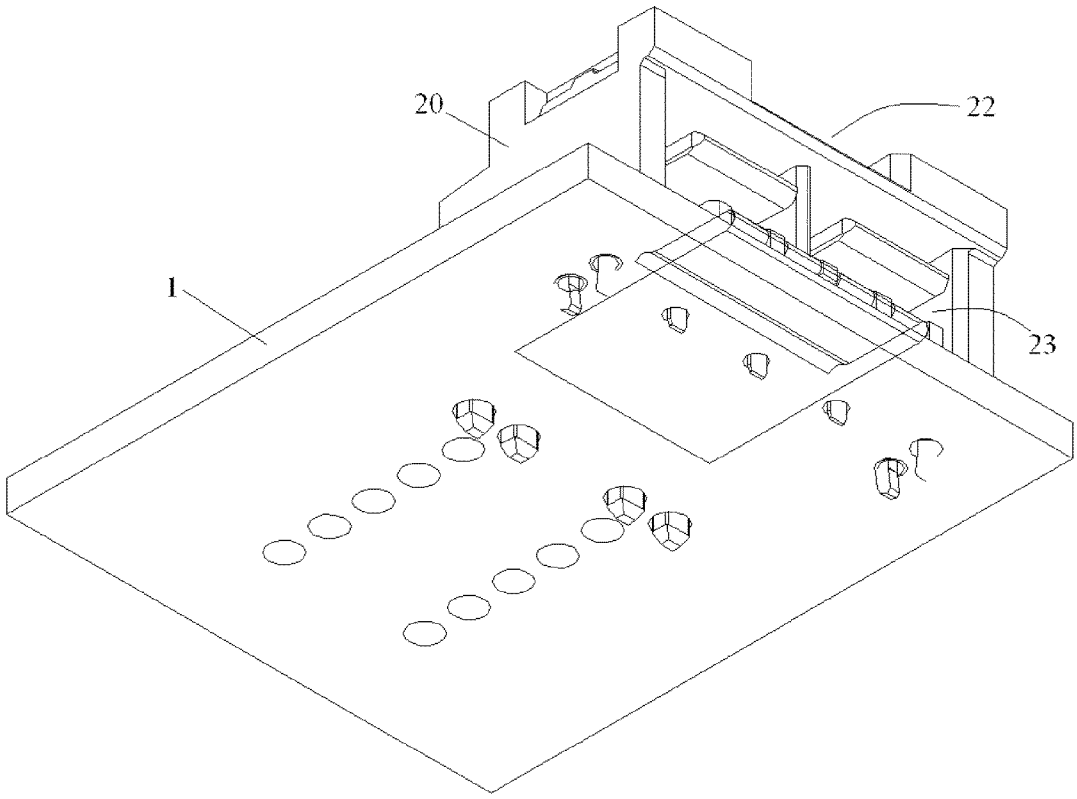
FIG. 9 is a bottom perspective view of the mating electrical connector of FIG. 8.

The use of the electrical connector 10 will now be described in greater detail with reference to FIGS. 7-9. The lock mechanism 400 shown in FIG. 7 is configured to lock the electrical connector 10 to a mating electrical connector 20 shown in FIGS. 8 and 9.

In the shown embodiments, the electrical connector 10 is a plug connector and the mating electrical connector 20 is a receptacle connector. The mating electrical connector 20 may be mounted on a panel, for example, a circuit board 1. The electrical connector 10 may be electrically connected to ends of wires of a cable. The electrical connector 10 and the mating electrical connector 20 may be a pair of power connectors for transmitting electric power, or alternatively, the electrical connector 10 and the mating electrical connector 20 may be connectors for transmitting signals or other types of connectors.

The electrical connector 10 has a front end and a rear end opposite to the front end in a length direction Y thereof. The front end of the electrical connector 10 is adapted to be inserted into a port 23 of the mating electrical connector 20, so that the conductive contacts in the electrical connector 10 electrically contact with conductive contacts 24 in the mating electrical connector 20. A fourth groove 22 for receiving a front of the resilient arm 420 therein is formed in the mating electrical connector 20, and a mating locking member 21 is formed on a bottom wall of the fourth groove 22.

As shown in FIGS. 5 and 7-9, the lock mechanism 400 is configured to be movable between a locking position and an unlocking position. In the locking position, the locking member 421 of the lock mechanism 400 is engaged to the mating locking member 21 of the mating electrical connector 20, so that the electrical connector 10 is locked to the mating electrical connector 20 and cannot be separated from the mating electrical connector 20. In the unlocking position, the locking member 421 of the lock mechanism 400 is disengaged from the mating locking member 21 of the mating electrical connector 20, so that the electrical connector 10 is allowed to be pulled out of the mating electrical connector 20.

When the electrical connector 10 is inserted into the mating electrical connector 20, the mating locking member 21 is snapped into the locking member 421 formed in one end of the resilient arm 420 of the electrical connector 10. In this way, the electrical connector 10 is locked to the mating electrical connector 20 in the locking position.

With the lock mechanism 400 in the locking position, when an activation force is exerted on the trigger 200 by pulling the strap 300, the trigger 200 is moved from a deactivated position to an activated position and pushes the lock mechanism 400 to move from the locking position to the unlocking position, so that the locking member 421 of the lock mechanism 400 is disengaged from the mating locking member 21 of the mating electrical connector 20. When the activation force is exerted on the trigger 200 by pulling the strap 300, the trigger 200 pivots and pushes the resilient arm 420 in a height direction Z to move to the unlocking position.

The lock mechanism 400 is configured to be able to automatically move from the unlocking position to the locking position upon removing the activation force from the trigger 200 by loosening the strap 300. When the activation force is removed from the trigger 200 by loosening the strap 300, the resilient arm 420 presses against the trigger 200 and automatically pivots the trigger 200 back to the deactivated position, also the locking position of the lock mechanism 400, under a restoring force of the resilient arm 420.

In the shown embodiment, the locking member 421 is a locking opening and the mating locking member 21 is a locking protrusion. In other embodiments, as would be understood by those with ordinary skill in the art, the locking member 421 may be a locking protrusion and the mating locking member 21 may be a locking opening.

Advantageously, in the electrical connector 10 according to the present invention, the lock mechanism 400 may be released by pulling the strap 300 in a horizontal direction instead of pressing the trigger 200 in a vertical direction. Accordingly, the present invention can reduce an operation space for releasing the lock mechanism 400, and the electrical connectors 10 of the present invention may be arranged in high density as the distance between adjacent electrical connectors 10 may become very small. Furthermore, the locking and unlocking mechanisms of the electrical connector 10 are simple to manufacture, decreasing the cost of the electrical connector 10.

What is claimed is:

1. An electrical connector, comprising:

a housing;

a lock mechanism mounted on the housing and having a locking member, the lock mechanism movable between a locking position in which the locking member locks the electrical connector to a mating electrical connector and an unlocking position in which the locking member is disengaged from the mating electrical connector;

a trigger pivotally mounted on the housing and movable between a deactivated position and an activated position, the trigger moving the lock mechanism from the locking position to the unlocking position as the trigger moves between the deactivated position and the activated position; and a strap connected to the trigger and operable to move the trigger from the deactivated position to the activated position upon applying an activation force to the strap.

2. The electrical connector of claim 1, wherein the lock mechanism automatically moves from the unlocking position to the locking position when the activation force is removed from the strap.

3. The electrical connector of claim 2, wherein the lock mechanism has a resilient arm on which the locking member is disposed, the trigger moves the resilient arm to the unlocking position when the activation force is applied to the strap, and the resilient arm automatically returns to the locking position when the activation force is removed from the strap.

4. The electrical connector of claim 3, wherein the trigger automatically moves from the activated position to the deactivated position under a restoring force of the resilient arm when the activation force is removed from the strap.

5. The electrical connector of claim 4, wherein the trigger has a lateral beam and a pair of end plates with one end plate located at each end of the lateral beam, the end plates pivotally connected to the housing such that the trigger is rotatable about an axis extending in a width direction of the housing.

6. The electrical connector of claim 5, wherein each end plate has a hole and the housing has a plurality of shafts, each of the plurality of shafts mating with the hole of one of the pair of end plates.

7. The electrical connector of claim 5, wherein the lateral beam has a pushing protrusion, the resilient arm is disposed above the lateral beam, and when the activation force is applied to the strap, the pushing protrusion is rotated about the axis and pushes the resilient arm toward the unlocking position.

8. The electrical connector of claim 7, wherein the lateral beam has a first slot and the strap has a second slot disposed in an end of the strap, the strap extending through the first slot and the second slot to connect the strap to the lateral beam.

9. The electrical connector of claim 8, wherein the strap is formed of a flexible material.

10. The electrical connector of claim 9, wherein the resilient arm extends in a length direction of the housing and the locking member is disposed on a first end of the resilient arm.

11. The electrical connector of claim 10, wherein the lock mechanism has a lateral connection arm extending in a width direction of the housing and connected to the opposite second end of the resilient arm, and a pair of connection pegs each extending downward from one end of the lateral connection arm, the pair of connection pegs inserted into a plurality of slots in the housing.

12. The electrical connector of claim 11, wherein a slit is formed in each connection peg and a plurality of projections are disposed on both sides of each connection peg, the plurality of projections engaging a plurality of recesses formed in an inner wall of each of the plurality of slots.

13. The electrical connector of claim 12, wherein the mating electrical connector has a mating locking member mating with the locking member of the lock mechanism, one of the locking member and the mating locking member is a protrusion and the other of the locking member and the mating locking member is an opening.

14. The electrical connector of claim 13, wherein the locking member is an opening and the mating locking member is a protrusion.

15. The electrical connector of claim 14, wherein the housing has a first groove receiving the trigger, a second groove receiving a portion of the strap, and a third groove receiving the lock mechanism.

16. The electrical connector of claim 15, wherein the second groove extends in the length direction of the housing.

17. The electrical connector of claim 15, wherein the mating electrical connector has a fourth groove receiving the first end of the resilient arm, the mating locking member disposed on a bottom wall of the fourth groove.

18. The electrical connector of claim 1, wherein the housing has a front end and a rear end in a length direction of the housing, the strap extending beyond the rear end of the housing.

19. The electrical connector of claim 18, wherein the front end of the housing is inserted into a port of the mating electrical connector.

20. An electrical connector assembly, comprising:

a first electrical connector including a housing, a lock mechanism mounted on the housing and having a locking member, the lock mechanism movable between a locking position and an unlocking position, a trigger pivotally mounted on the housing and movable between a deactivated position and an activated position, the trigger moving the lock mechanism from the locking position to the unlocking position as the trigger moves between the deactivated position and the activated position, and a strap connected to the trigger and operable to move the trigger from the deactivated position to the activated position upon applying an activation force to the strap; and a second electrical connector mated with the first electrical connector, the locking member locking the first electrical connector to the second electrical connector in the locking position and disengaged from the second electrical connector in the unlocking position.

21. The electrical connector of claim 1, wherein the trigger and the strap are formed separately.

22. The electrical connector of claim 11, wherein the pair of connection pegs fix the lateral connection arm with respect to the housing.

23. The electrical connector of claim 22, wherein the pushing protrusion deflects the resilient arm during rotation of the trigger from the deactivated position to the activated position.

* * * * *